US011746801B2

(12) United States Patent
Sahlman et al.

(10) Patent No.: US 11,746,801 B2
(45) Date of Patent: Sep. 5, 2023

(54) HYDRAULIC DEVICE, A HYDRAULIC SYSTEM AND A WORKING MACHINE

(71) Applicants: Volvo Construction Equipment AB, Eskilstuna (SE); Norrhydro Oy, Rovaniemi (FI)

(72) Inventors: Mika Sahlman, Tampere (FI); Kim Heybroek, Kvicksund (SE)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 17/606,035

(22) PCT Filed: Apr. 24, 2019

(86) PCT No.: PCT/EP2019/060441
§ 371 (c)(1),
(2) Date: Oct. 24, 2021

(87) PCT Pub. No.: WO2020/216440
PCT Pub. Date: Oct. 29, 2020

(65) Prior Publication Data

US 2022/0205461 A1 Jun. 30, 2022

(51) Int. Cl.
*F15B 1/027* (2006.01)
*E02F 9/22* (2006.01)
*F15B 1/26* (2006.01)

(52) U.S. Cl.
CPC ..... *F15B 1/027* (2013.01); *E02F 9/2289* (2013.01); *F15B 1/265* (2013.01); *E02F 9/2217* (2013.01);
(Continued)

(58) Field of Classification Search
CPC .. F15B 1/021; F15B 1/024; F15B 3/00; F15B 11/17; F15B 21/14; E02F 9/2217; E02F 9/2292
See application file for complete search history.

(56) References Cited

U.S. PATENT DOCUMENTS 5,971,027 A * 10/1999 Beachley ..... F15B 1/02 138/30
8,286,426 B2 * 10/2012 Bishop ..... F15B 3/00 60/413

(Continued)

FOREIGN PATENT DOCUMENTS

CN 104093979 A 10/2014
CN 105275037 A 1/2016
CN 106223391 A 12/2016

OTHER PUBLICATIONS

International Search Report and Written Opinion of the International Searching Authority, PCT/EP2019/060441, dated Jan. 27, 2020, 13 pages.

(Continued)

*Primary Examiner* — Michael Leslie
(74) *Attorney, Agent, or Firm* — Sage Patent Group

(57) ABSTRACT

The invention relates to a hydraulic device for a hydraulic system (12). The hydraulic device includes a chamber arrangement including at least one high-pressure chamber for connection to a high-pressure side of the hydraulic system, and at least one low-pressure chamber for connection to a low-pressure side of the hydraulic system; and a movable member arranged to reciprocate at least partly inside the chamber arrangement in response to pressure variations within the at least one high-pressure chamber and within the at least one low-pressure chamber. The chamber arrangement further includes at least one tank chamber for connection to a tank-pressure side of the hydraulic system.

18 Claims, 7 Drawing Sheets

(52) U.S. Cl.
CPC ... *E02F 9/2292* (2013.01); *F15B 2211/20569* (2013.01); *F15B 2211/20576* (2013.01); *F15B 2211/212* (2013.01); *F15B 2211/625* (2013.01); *F15B 2211/7135* (2013.01)

(56) References Cited

U.S. PATENT DOCUMENTS

| | | | | |
|---|---|---|---|---|
| 9,021,798 | B2 * | 5/2015 | Sipola | F15B 21/14 60/428 |
| 9,631,647 | B2 | 4/2017 | Schulz et al. | |
| 10,072,680 | B2 * | 9/2018 | Hahn | E02F 9/2271 |
| 10,323,657 | B2 * | 6/2019 | Schulz | F15B 3/00 |
| 10,767,664 | B2 * | 9/2020 | Mickowski | F15B 3/00 |
| 11,105,346 | B2 * | 8/2021 | Zavadinka | F15B 11/032 |
| 2009/0178399 | A1 | 7/2009 | Bishop | |
| 2009/0317267 | A1 * | 12/2009 | Gill | F15B 3/00 417/505 |
| 2011/0259187 | A1 | 10/2011 | Sipola et al. | |
| 2012/0233997 | A1 | 9/2012 | Andruch, III et al. | |
| 2014/0366717 | A1 | 12/2014 | Tsukane | |
| 2016/0061229 | A1 | 3/2016 | Lind et al. | |
| 2017/0023025 | A1 | 1/2017 | Hahn et al. | |
| 2018/0180065 | A1 | 6/2018 | Shimada | |

OTHER PUBLICATIONS

Paloniitty, Miika et al. "Compact and Efficient Implementation of a Pressured Tank Line," White Paper, Tampere University of Technology, Nov. 6, 2018, 4 pages.

Chinese First Office Action dated Jun. 22, 2022 for Chinese Patent Application No. 201980095596.9, 14 pages (including English translation).

* cited by examiner

HYDRAULIC DEVICE, A HYDRAULIC SYSTEM AND A WORKING MACHINE

CROSS REFERENCE TO RELATED APPLICATIONS

This application is a 35 U.S.C. § 371 national stage application of PCT International Application No. PCT/EP2019/060441 filed on Apr. 24, 2019, the disclosure and content of which is incorporated by reference herein in its entirety.

TECHNICAL FIELD

The invention relates to a hydraulic device for a hydraulic system, a hydraulic system for a working machine, and a working machine.

The invention is applicable on hydraulic systems of working machines within the fields of industrial construction machines, material handling machines or construction equipment, in particular wheel loaders and excavators. Although the invention will be described with respect to an excavator, the invention is not restricted to this particular machine, but may be used in any working machine comprising a hydraulic system with a high-pressure side, a low-pressure side and a tank-pressure side, such as wheel loaders, articulated or rigid haulers and backhoe loaders. The invention is also applicable on hydraulic systems for applications other than working machines, for example on a hydraulic system of a hydraulic lift.

BACKGROUND

Hydraulic systems are used in a wide range of applications. For example, working machines typically rely on hydraulic systems to provide power for handling a load. A hydraulic system for a working machine may comprise various hydraulic actuators, for example hydraulic cylinders and rotary hydraulic motors. Hydraulic hybrid systems can be used to recuperate energy from the hydraulic actuators and use it later to reduce the loading of an internal combustion engine. During recuperation when a hydraulic actuator pushes oil to a high-pressure side, e.g. for storing energy in a high-pressure accumulator, the hydraulic actuator requires a supply of pressurized oil to maintain a sufficiently large pressure on the suction side in order to avoid cavitation. This supply may be provided from a low-pressure side comprising a low-pressure accumulator.

Hydraulic systems comprising a dedicated high-pressure side and a dedicated low-pressure side may be referred to as dual pressure hydraulic systems, and are previously known as such. Dual pressure hydraulic systems typically comprise one or more high-pressure accumulators connected to a high-pressure side, and one or more low-pressure accumulators connected to a low-pressure side. Advantages associated with dual pressure hydraulic systems are for example improved energy efficiency and controllability.

However, dual pressure hydraulic systems for working machines include a high numbers of parts, e.g. for subsystems, so space is often limited. Thereby, the integration of an energy recuperation arrangement in such dual pressure hydraulic system is often difficult.

Reference 1 discloses a concept, where a pump rotary shaft seal is replaced to withstand an elevated pressure in order to get rid of an ambient pressure tank. Reference 1: Compact and efficient implementation of a pressurized tank line; Paloniitty, Miika; Linjama, Matti; Huova, Mikko; Tampere University of Technology; 4 p. 2018; White paper; 6 Nov. 2018.

SUMMARY

An object of the invention is to provide a hydraulic device for a hydraulic system, which hydraulic device has a simple, cheap and compact design, and enables a simple, cheap and compact hydraulic system.

The object is achieved by a hydraulic device for a hydraulic system according to claim 1. This hydraulic device comprises a chamber arrangement comprising at least one high-pressure chamber for connection to a high-pressure side of the hydraulic system, and at least one low-pressure chamber for connection to a low-pressure side of the hydraulic system; a movable member arranged to reciprocate at least partly inside the chamber arrangement in response to pressure variations within the at least one high-pressure chamber and within the at least one low-pressure chamber. The chamber arrangement further comprises at least one tank chamber for connection to a tank-pressure side of the hydraulic system.

The provision of the at least one tank chamber in the chamber arrangement enables removal of a conventional tank from the hydraulic system. Thereby, the hydraulic system can be made simpler, cheaper and more compact.

The at least one low-pressure chamber of the hydraulic device further eliminates the need for low-pressure accumulators in the hydraulic system. By means of the hydraulic device, pressurization of hydraulic fluid in the high-pressure side and the low-pressure side can be achieved without the need for springs or a sealed gas charge, as in a conventional low-pressure accumulator. The removal of one or more low-pressure accumulators and associated safety valves from the hydraulic system simplifies the hydraulic device and reduces costs.

The hydraulic device according to the invention constitutes a three-level tank with three different pressure levels. Since the movable member is arranged to reciprocate in response to pressure variations in the high-pressure chamber and/or the low-pressure chamber, the hydraulic device may be said to provide a self-pressurizing accumulator or bootstrap accumulator.

The high pressure is higher than the low pressure. The low pressure is higher than the tank pressure. The pressures in the high-pressure side, the low-pressure side and the tank-pressure side are not limited to any specific pressure values. Rather, the terminologies "high pressure", "low pressure" and "tank pressure" indicate that these pressure levels are different and that the low pressure is higher than the tank pressure, but lower than the high pressure. The pressure levels, or ranges of pressure levels, in the high-pressure side, the low-pressure side and the tank-pressure side are selected depending on each configuration. The pressure levels in the high-pressure side, the low-pressure side and the tank-pressure side may vary during operation of the hydraulic system. For example, the high pressure may vary between 200-350 bars, the low pressure may vary between 15-30 bars and the tank pressure may vary between 1-5 bars, during operation of the hydraulic system.

The high-pressure side may be referred to as a source of hydraulic power arranged to both produce and receive a volume flow at a first pressure level and the low-pressure side may be referred to as a source of hydraulic power arranged to both produce and receive a volume flow at a second pressure level, lower than the first pressure level. The tank pressure may be higher than atmospheric pressure. The tank pressure may for example be 2 bars ±10%.

The total area of the movable member exposed to the at least one high-pressure chamber may be referred to as a high-pressure area. The total area of the movable member exposed to the at least one low-pressure chamber may be referred to as a low-pressure area. In the hydraulic device, the low-pressure area is larger than the high-pressure area and the ratio between the high-pressure area and the low-pressure area provides a pressure multiplication effect. Thus, the hydraulic device comprises active areas of different sizes. Thereby, hydraulic fluid in the low-pressure side can be pressurized by the hydraulic fluid in the high-pressure side via the movable member, and vice versa.

The at least one tank chamber may for example be integrated in the chamber arrangement. This further simplifies manufacture of the hydraulic device. The chamber arrangement may be a cylinder arrangement.

The hydraulic device may comprise one or several high-pressure chambers, one or several low-pressure chambers and one or several tank chambers. Each high-pressure chamber, each low-pressure chamber and each tank chamber may have a circular or non-circular cross-section. According to one example, the at least one tank chamber encloses the at least one high-pressure chamber.

The movable member may delimit each of the at least one high-pressure chamber and each of the at least one low-pressure chamber. When the pressure in the high-pressure side increases, the movable member moves towards the at least one low-pressure chamber. Correspondingly, when the pressure in the low-pressure side increases, the movable member moves towards the at least one high-pressure chamber. The movable member is thus arranged to move back and forth in reaction to pressure variations in the at least one high-pressure chamber and the at least one low-pressure chamber. Thereby, a predefined relationship between the high pressure and the low pressure can be maintained, or substantially maintained, by means of the hydraulic device.

According to one embodiment, the at least one tank chamber is configured to communicate air with the atmosphere. To this end, the hydraulic device may comprise one or more valves arranged to open and close a fluid communication path between the at least one tank chamber and the atmosphere. The one or more valves may operate either actively or passively.

According to one embodiment, the at least one tank chamber is vented to the atmosphere. The at least one tank chamber may be configured to automatically vent to atmosphere when a difference between the tank pressure and the atmospheric pressure exceeds one bar. To this end, the hydraulic device may for example comprises one or more differential pressure valves.

According to one embodiment, the hydraulic device comprises a housing, and wherein the at least one high-pressure chamber, the at least one low-pressure chamber and the at least one tank chamber are provided inside the housing. By providing the at least one high-pressure chamber, the at least one low-pressure chamber and the at least one tank chamber inside a common housing, a particularly compact hydraulic device is provided. The housing may for example be constituted by a cylinder.

According to one embodiment, the at least one tank chamber is limited by a wall of the housing. Thereby, the space within the housing is utilized efficiently and the hydraulic device is made compact.

According to one embodiment, the at least one high-pressure chamber and/or the at least one low-pressure chamber is limited by a wall of the housing. Thereby, the space within the housing is utilized efficiently and the hydraulic device is made compact.

According to one embodiment, the hydraulic device further comprises at least one high-pressure hydraulic energy storage for connection to the high-pressure side, wherein the at least one high-pressure hydraulic energy storage is arranged inside one of the at least one tank chamber or inside one of the at least one low-pressure chamber. The at least one high-pressure hydraulic energy storage may be a hydraulic accumulator, such as a hydro-pneumatic accumulator.

According to one embodiment, the chamber arrangement comprises a first cylinder and a second cylinder. Each of the first cylinder and the second cylinder may have a circular cross-section, or a non-circular cross-section, such as a polygonal cross-section.

According to one embodiment, the at least one tank chamber is provided inside the first cylinder and/or the second cylinder. This contributes to a compact and simple design of the hydraulic device.

According to one embodiment, the first cylinder has a larger interior cross-sectional area than the second cylinder.

According to one embodiment, the second cylinder is arranged inside the first cylinder.

According to one embodiment, the movable member comprises two pistons. Each piston may for example have a circular or polygonal shape.

According to one embodiment, a first piston is arranged to reciprocate inside the first cylinder, wherein a second piston is arranged to reciprocate inside the second cylinder, and wherein the second piston delimits one of the at least one high-pressure chamber.

According to one embodiment, at least one of the pistons delimits one of the at least one tank chamber.

The invention also relates to a hydraulic system for a working machine. The hydraulic system comprises a high-pressure side; a low-pressure side; a tank-pressure side; and a hydraulic device according to the invention. The at least one high-pressure chamber is connected to the high-pressure side, the at least one low-pressure chamber is connected to the low-pressure side, and the at least one tank chamber is connected to the tank-pressure side. During operation of the hydraulic system, the high pressure is higher than the low pressure, and the low pressure is higher than the tank pressure. The high-pressure side and the low-pressure side may be arranged in a common pressure rail architecture. The high-pressure side may comprise a high-pressure rail and the low-pressure side may comprise a low-pressure rail.

According to one embodiment, the movable member comprises a high-pressure area in the at least one high-pressure chamber and a low-pressure area in the at least one low-pressure chamber, and wherein a ratio between the high-pressure area and the low-pressure area substantially corresponds to, or corresponds to, a pressure ratio between the high-pressure side and the low-pressure side in operation of the hydraulic system. In operation of the hydraulic system, hydraulic fluid in the high-pressure side acts on at least one side of the movable member, and hydraulic fluid in the low-pressure side acts on at least one side of the movable member.

Based on a ratio between the high-pressure area and the low-pressure area of the movable member, a pressure multiplication effect is achieved which provides fluid pressurization without the need for springs (except an optional spring for the tank chamber) or a sealed gas charge. In case the tank chamber is pressurized during operation of the hydraulic device, the ratio between the high-pressure area and the low-pressure area may not perfectly correspond to the pressure ratio between the high-pressure side and the low-pressure side.

According to one embodiment, the hydraulic system further comprises a main pump connected between the low-pressure side and the high-pressure side. The main pump may be constituted by a hydraulic machine operative as a pump and motor.

According to one embodiment, the hydraulic system further comprises an auxiliary pump connected between the tank-pressure side and one of the high-pressure side and the low-pressure side. The auxiliary pump may be used in a start-up sequence of the hydraulic system, during which the auxiliary pump pressurizes the high-pressure side or the low-pressure side. The other of the high-pressure side and the low-pressure side will then be pressurized by means of the hydraulic device. The main pump and the auxiliary pump may be driven by a common drive shaft. Alternatively, or in addition, the auxiliary pump may have a fixed displacement.

The invention also relates to a working machine comprising the hydraulic system. The working machine may for example be an excavator, a wheel loader, an articulated or rigid hauler or a backhoe loader.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
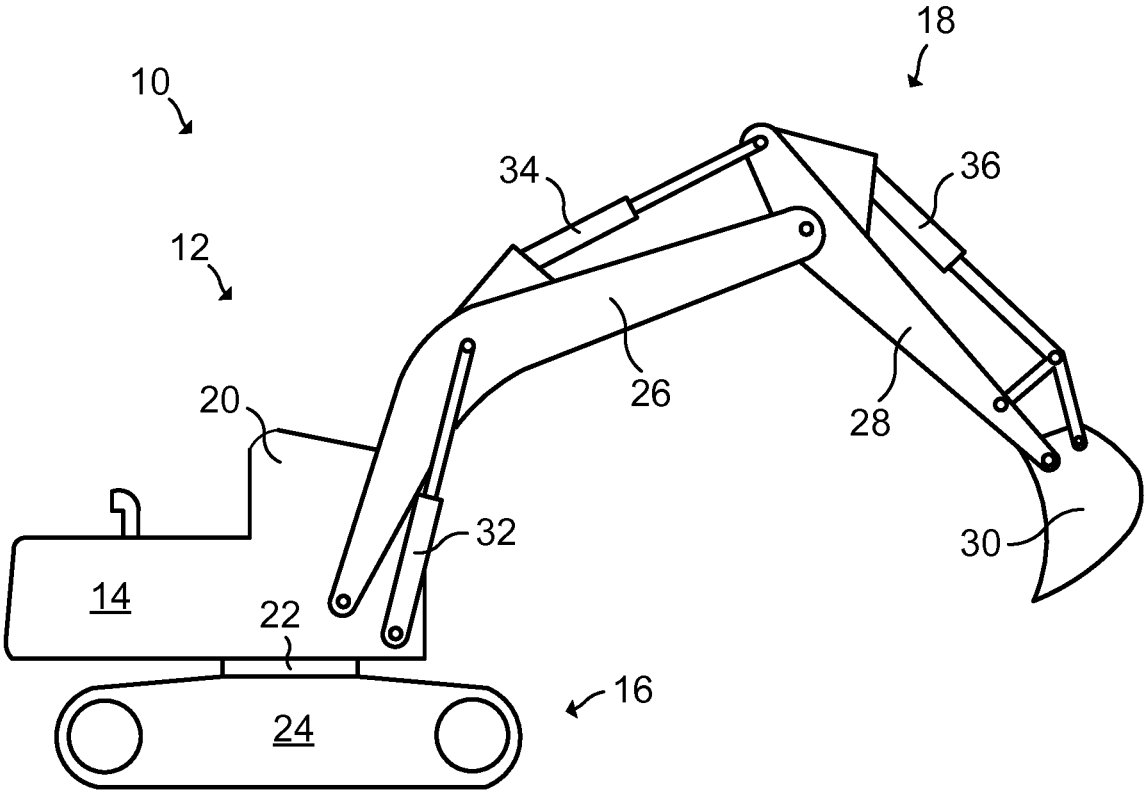
FIG. 1 is a schematic illustration of a working machine according to the invention comprising a hydraulic system.

In the following, a hydraulic device for a hydraulic system, a hydraulic system for a working machine, and a working machine comprising a hydraulic system, will be described. The same reference numerals will be used to denote the same or similar structural features.

FIG. 1 is a schematic illustration of a working machine 10 according to the invention. The working machine 10 comprises a hydraulic system 12 according to the invention.

In FIG. 1, the working machine 10 is exemplified as an excavator. The working machine 10 comprises an upper swing structure 14, a lower travel structure 16 and a working device 18. The working machine 10 further comprises a cab 20 in the upper swing structure 14, and a swing motor 22 between the upper swing structure 14 and the lower travel structure 16. The lower travel structure 16 comprises a travel device 24, here exemplified as two crawler tracks (only one is visible in FIG. 1).

The working device 18 comprises a boom 26, an arm 28 and a bucket 30. The working device 18 further comprises two boom cylinders 32 (only one is visible in FIG. 1), an arm cylinder 34 and a bucket cylinder 36. The boom cylinders 32 operate between the upper swing structure 14 and the boom 26. The arm cylinder 34 operates between the boom 26 and the arm 28. The bucket cylinder 36 operates between the arm 28 and the bucket 30.

Figure 2:
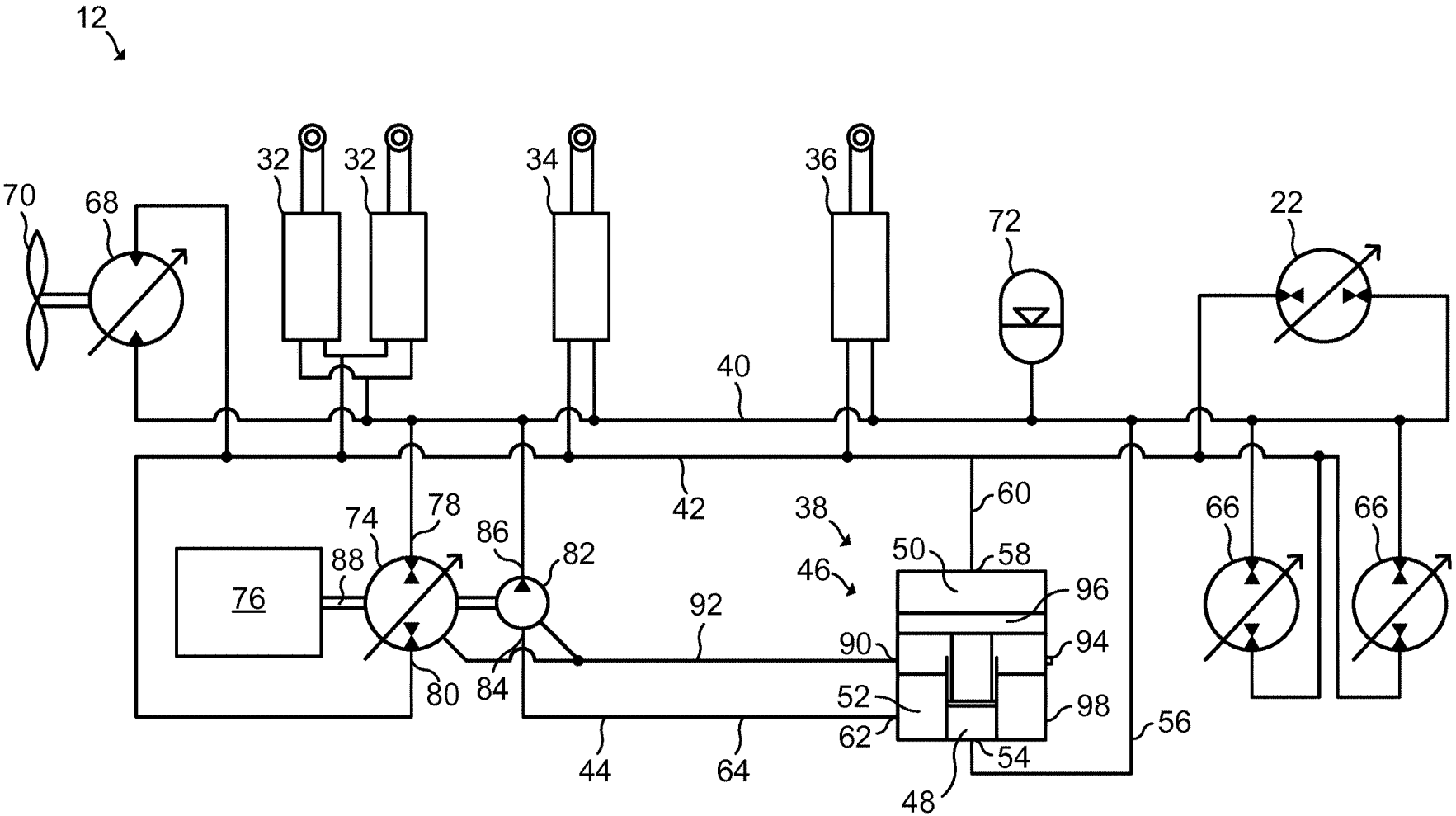
FIG. 2 is a block diagram of a hydraulic system according to an embodiment of the invention comprising a hydraulic device according to an embodiment of the invention.

FIG. 2 is a block diagram of the hydraulic system 12 in FIG. 1 according to an embodiment of the invention. The hydraulic system 12 comprises a hydraulic device 38 according to an embodiment of the invention. The hydraulic system 12 further comprises a high-pressure side 40, a low-pressure side 42 and a tank-pressure side 44.

In the example in FIG. 2, the high-pressure side 40 and the low-pressure side 42 are arranged in a common pressure rail (CPR) architecture. The high-pressure side 40 comprises a high-pressure rail and the low-pressure side 42 comprises a low-pressure rail. The high-pressure side 40 and the low-pressure side 42 may alternatively be referred to as a high-pressure circuit and a low-pressure circuit, respectively. The high-pressure side 40 and the low-pressure side 42 form a dual pressure system comprising two charging circuits at different pressure levels (the high-pressure side 40 and the low-pressure side 42).

During operation of the hydraulic system 12, the pressure in the low-pressure side 42 is lower than the pressure in the high-pressure side 40, and higher than the pressure in the tank-pressure side 44. These three pressure levels may vary somewhat during operation of the hydraulic system 12 while the pressure in the high-pressure side 40 is higher than the pressure in the low-pressure side 42 and the pressure in the low-pressure side 42 is higher than the pressure in the tank-pressure side 44.

The high pressure in the high-pressure side 40 may for example vary between 200-350 bars during operation of the hydraulic system 12. The low pressure in the low-pressure side 42 may for example vary between 15-30 bars during operation of the hydraulic system 12. The tank pressure in the tank-pressure side 44 may for example vary between 1-5 bars during operation of the hydraulic system 12.

The hydraulic device 38 comprises a chamber arrangement 46. The chamber arrangement 46 of the hydraulic device 38 comprises a high-pressure chamber 48, a low-pressure chamber 50 and a tank chamber 52. The tank chamber 52 is integrated in the hydraulic device 38.

The hydraulic device 38 further comprises a high-pressure connection 54 to the high-pressure chamber 48. The hydraulic system 12 comprises a high-pressure line 56 connected between the high-pressure connection 54 and the high-pressure side 40. The hydraulic device 38 further comprises a low-pressure connection 58 to the low-pressure chamber 50. The hydraulic system 12 comprises a low-pressure line 60 connected between the low-pressure connection 58 and the low-pressure side 42. The hydraulic device 38 further comprises a tank suction connection 62 to the tank chamber 52. The hydraulic system 12 further comprises a suction line 64 in the tank-pressure side 44 connected to the tank suction connection 62.

In addition to the swing motor 22 shown in FIG. 1, the hydraulic system 12 further comprises two travel motors 66 and a fan motor 68. The hydraulic system 12 further comprises a fan 70 arranged to be driven by the fan motor 68. The swing motor 22 is arranged to rotate the upper swing structure 14 relative to the lower travel structure 16. The travel motors 66 are arranged to drive a respective crawler track of the lower travel structure 16. As shown in FIG. 2, each of the boom cylinders 32, the arm cylinder 34, the bucket cylinder 36, the fan motor 68, the swing motor 22 and the travel motors 66 is connected to the high-pressure side 40 and the low-pressure side 42.

The hydraulic system 12 further comprises a high-pressure hydraulic energy storage 72. The high-pressure hydraulic energy storage 72 is connected to the high-pressure side 40. In FIG. 2, the high-pressure hydraulic energy storage 72 is exemplified as an accumulator. The high-pressure hydraulic energy storage 72 is configured to store/release hydraulic energy from/to the high-pressure side 40. A large pressure variation range in the high-pressure side facilitates storage and release of hydraulic energy by means of the high-pressure hydraulic energy storage 72.

The hydraulic system 12 further comprises a main pump 74. The main pump 74 is arranged to be driven by an internal combustion engine 76 of the working machine 10. In FIG. 1, a high-pressure port 78 of the main pump 74 is connected to the high-pressure side 40 and a low-pressure port 80 of the main pump 74 is connected to the low-pressure side 42. The main pump 74 is thus connected between the high-pressure side 40 and the low-pressure side 42. The main pump 74 is here exemplified as a hydraulic machine operative as both pump and motor.

The hydraulic system 12 further comprises an auxiliary pump 82. In the example in FIG. 1, a suction side 84 of the auxiliary pump 82 is connected to the suction line 64 of the tank-pressure side 44 and a discharge side 86 of the auxiliary pump 82 is connected to the high-pressure side 40. Thus, the auxiliary pump 82 of this example is connected between the tank-pressure side 44 and the high-pressure side 40. The auxiliary pump 82 may however alternatively be connected between the tank-pressure side 44 and the low-pressure side 42. The auxiliary pump 82 is configured to pump fluid from the the tank-pressure side 44 back to the high-pressure side 40 (or back to the low-pressure side 42).

The auxiliary pump 82 of this example is a fixed displacement pump. Furthermore, the main pump 74 and the auxiliary pump 82 are connected to a common drive shaft 88 driven by the internal combustion engine 76.

The hydraulic device 38 further comprises a tank return connection 90 to the tank chamber 52. The hydraulic system 12 further comprises a return line 92. The return line 92 is arranged to receive leakage fluid from each of the main pump 74 and the auxiliary pump 82. The leakage fluid is led through the return line 92 and is discharged into the tank chamber 52 through the tank return connection 90.

A valve (not shown) may be provided downstream of the auxiliary pump 82. By means of this valve, the flow from the auxiliary pump 82 to the high-pressure side 40 (or to the low-pressure side 42) can be stopped after a start-up sequence.

The hydraulic device 38 further comprises a vent opening 94. The vent opening 94 is configured to provide air communication between the tank chamber 52 and the surrounding atmosphere. A valve (not illustrated) may be provided in the vent opening 94 and may be arranged to open and close a fluid communication path between the tank chamber 52 and the atmosphere, either passively or actively. By means of the valve in the vent opening 94, the tank chamber 52 can be configured to automatically vent air to the atmosphere when a difference between a pressure in the tank chamber 52 and the atmosphere exceeds a threshold value, for example 1 bar.

The connections between the high-pressure line 56 and the high-pressure connection 54, between the low-pressure line 60 and the low-pressure connection 58, and/or between the suction line 64 and the tank suction connection 62 may optionally be closed in some operating states of the hydraulic system 12. The chamber arrangement 46 of the hydraulic device 38 thus comprises a high-pressure chamber 48 for connection to the high-pressure side 40, a low-pressure chamber 50 for connection to the low-pressure side 42 and a tank chamber 52 for connection to the tank-pressure side 44. The hydraulic device 38 thereby constitutes a three-level tank operative with three different pressure levels.

The hydraulic device 38 further comprises a movable member 96. The movable member 96 is arranged to reciprocate at least partly inside the chamber arrangement 46 in response to pressure variations within the high-pressure chamber 48 and the low-pressure chamber 50.

In the example in FIG. 2, the hydraulic device 38 comprises a housing 98. The housing 98 is here exemplified as a cylinder. The high-pressure chamber 48, the low-pressure chamber 50 and the tank chamber 52 are provided inside the housing 98. Each of the low-pressure chamber 50 and the tank chamber 52 is limited by a wall of the housing 98. As can be gathered from FIG. 2, the hydraulic device 38 has a particularly compact design.

The movable member 96 is arranged to reciprocate entirely inside the chamber arrangement 46 and inside the housing 98 in response to pressure variations within the high-pressure chamber 48 and within the low-pressure chamber 50. The hydraulic device 38 may thereby be said to constitute a self-pressurizing accumulator or bootstrap accumulator.

For example, when the pressure in the high-pressure side 40 increases and/or the pressure in the low-pressure side 42 decreases, the movable member 96 moves towards the low-pressure chamber 50 (upwards in FIG. 2). When the pressure in the high-pressure side 40 decreases and/or the pressure in the low-pressure side 42 increases, the movable member 96 moves towards the high-pressure chamber 48 (downwards in FIG. 2). The hydraulic device 38 thereby functions to maintain, or substantially maintain, a predefined pressure difference between the high-pressure side 40 and the low-pressure side 42.

During start-up, the auxiliary pump 82 will rapidly pressurize the high-pressure side 40. By means of the hydraulic device 38, also the low-pressure side 42 will thereby be pressurized rapidly. In this way, the hydraulic system 12 may be said to be "pretensioned". As an alternative, the discharge of the auxiliary pump 82 may be connected to the low-pressure side 42 such that the high-pressure side 40 is pressurized via the hydraulic device 38 and the hydraulic system 12 is rapidly pretensioned. Once the hydraulic system 12 is pretensioned, the main pump 74 can start its operation.

In FIG. 2, the area of the movable member 96 exposed to the low-pressure chamber 50 is larger than the area of the movable member 96 exposed to the high-pressure chamber 48. The area of the movable member 96 exposed to the high-pressure chamber 48 constitutes a high-pressure area and the area of the movable member 96 exposed to the low-pressure chamber 50 constitutes a low-pressure area. The ratio between the high-pressure area and the low-pressure area provides a multiplication effect or pressure ratio. The relatively small tank pressure in the tank chamber 52 and in the tank-pressure side 44 may for example be accomplished by means of a spring (not shown). The pressure ratio between the high-pressure side 40 and the low-pressure side 42 may be slightly offset due to the pressure in the tank chamber 52. In the example in FIG. 2, both the pressure in the tank chamber 52 and the pressure in the high-pressure chamber 48 act on the movable member 96 in one direction (upwards in FIG. 2) and the pressure in the low-pressure chamber 50 acts on the movable member 96 in the opposite direction (downwards in FIG. 2). Thus, in the example in FIG. 2, the ratio between the high-pressure area and the low-pressure area substantially, but not perfectly, corresponds to the ratio between the pressure in the high-pressure side 40 and the low-pressure side 42.

Figure 3:
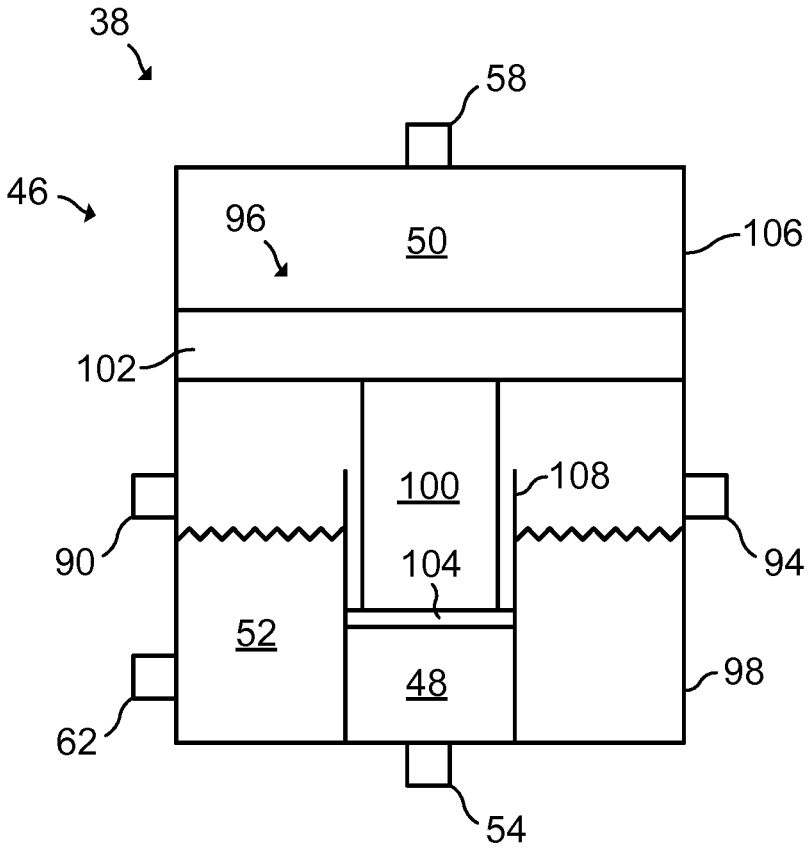
FIG. 3 is a schematic illustration of the hydraulic device in FIG. 2.

FIG. 3 is a schematic illustration of the hydraulic device 38 in FIG. 2. As shown in FIG. 3, the movable member 96 of this example comprises a piston rod 100. The movable member 96 further comprises a first piston 102 and a second piston 104 at opposite sides of the piston rod 100. The first piston 102 faces and delimits the low-pressure chamber 50 and the second piston 104 faces and delimits the high-pressure chamber 48. Each of the first piston 102 and the second piston 104 in this example has a circular shape.

The hydraulic device 38 further comprises a first cylinder 106 and a second cylinder 108. The first piston 102 is arranged to reciprocate inside the first cylinder 106 and the second piston 104 is arranged to reciprocate inside the second cylinder 108.

The second cylinder 108 is arranged inside the first cylinder 106. Each of the first cylinder 106 and the second cylinder 108 has a uniform circular cross-section. The first cylinder 106 has a larger interior cross section than the second cylinder 108. In this example, the first cylinder 106 also constitutes the housing 98 of the hydraulic device 38.

In FIG. 3, the tank chamber 52 surrounds the second cylinder 108. The tank chamber 52 is provided inside the first cylinder 106 (in this case the housing 98). The tank chamber 52 is limited by the first cylinder 106, the second cylinder 108 and the first piston 102. The high-pressure chamber 48 is formed inside the second cylinder 108 and is limited by the second piston 104. The tank chamber 52 entirely surrounds the high-pressure chamber 48. The low-pressure chamber 50 is limited be the first cylinder 106 (in this case the housing 98) and the first piston 102. By means of the first piston 102 and the second piston 104, the movable member 96 delimits the low-pressure chamber 50 and the high-pressure chamber 48, respectively.

Figure 4:
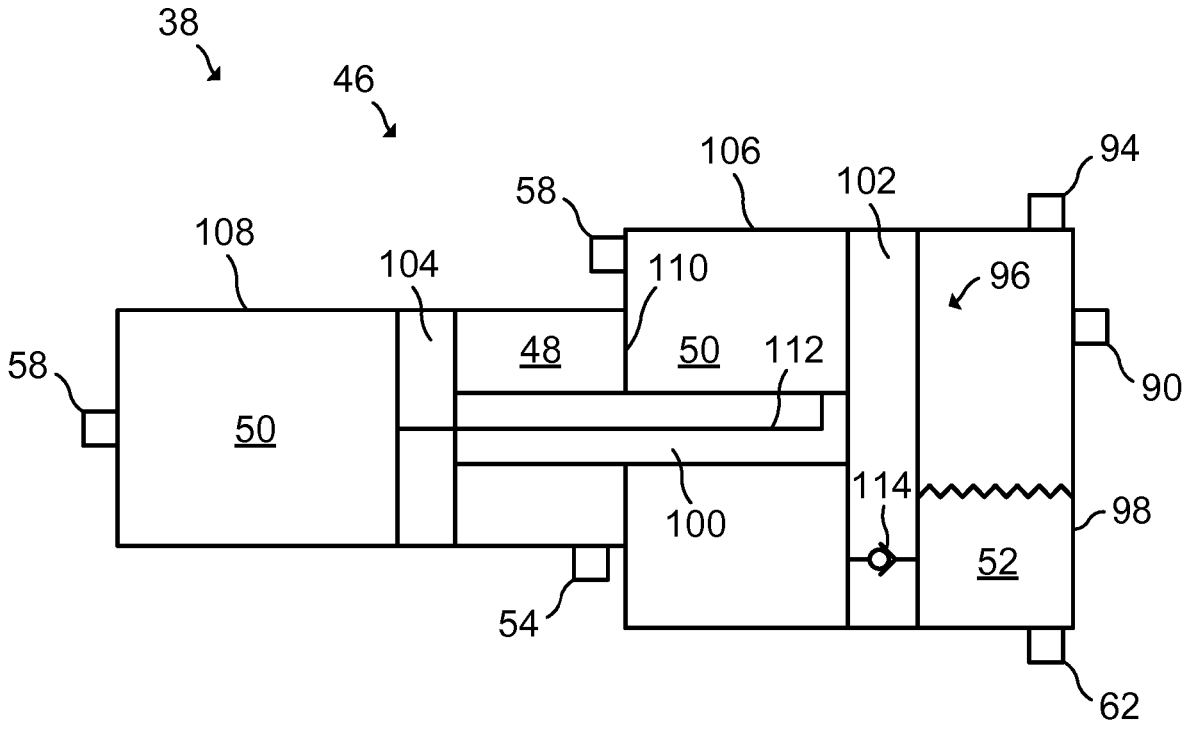
FIG. 4 is a schematic illustration of a hydraulic device according to a further embodiment of the invention.

FIG. 4 is a schematic illustration of a hydraulic device 38 according to a further embodiment of the invention. Mainly differences with respect to the embodiment in FIG. 3 will be described. In FIG. 4, the first cylinder 106 and the second cylinder 108 are arranged side-by-side. The hydraulic device 38 comprises a partition wall 110 between the first cylinder 106 and the second cylinder 108. The piston rod 100 extends through the partition wall 110.

In FIG. 4, a low-pressure chamber 50 and a tank chamber 52 are formed in the first cylinder 106 and are limited by the first piston 102. A low-pressure chamber 50 and a high-pressure chamber 48 are formed in the second cylinder 108 and are limited by the second piston 104. The hydraulic device 38 in FIG. 2 thus comprises two low-pressure chambers 50.

The hydraulic device 38 further comprises a communication passage 112 formed in the piston rod 100. The communication passage 112 establishes a fluid communication between the low-pressure chamber 50 formed in the first cylinder 106 and the low-pressure chamber 50 formed in the second cylinder 108.

The hydraulic device 38 further comprises a check valve 114 formed in the first piston 102. The check valve 114 allows fluid flow from the tank chamber 52 to the low-pressure chamber 50 in the first cylinder 106 but prevents fluid flow from the low-pressure chamber 50 in the first cylinder 106 to the tank chamber 52.

In FIG. 4, the low-pressure chamber 50 in the first cylinder 106 is limited by the first cylinder 106, the housing 98, the partition wall 110 and the first piston 102. The tank chamber 52 is limited by the first cylinder 106, the housing 98 and the first piston 102. The low-pressure chamber 50 in the second cylinder 108 is limited by the second cylinder 108, the housing 98 and the second piston 104. The high-pressure chamber 48 is limited by the second cylinder 108, the housing 98, the partition wall 110 and the second piston 104.

Figure 5:
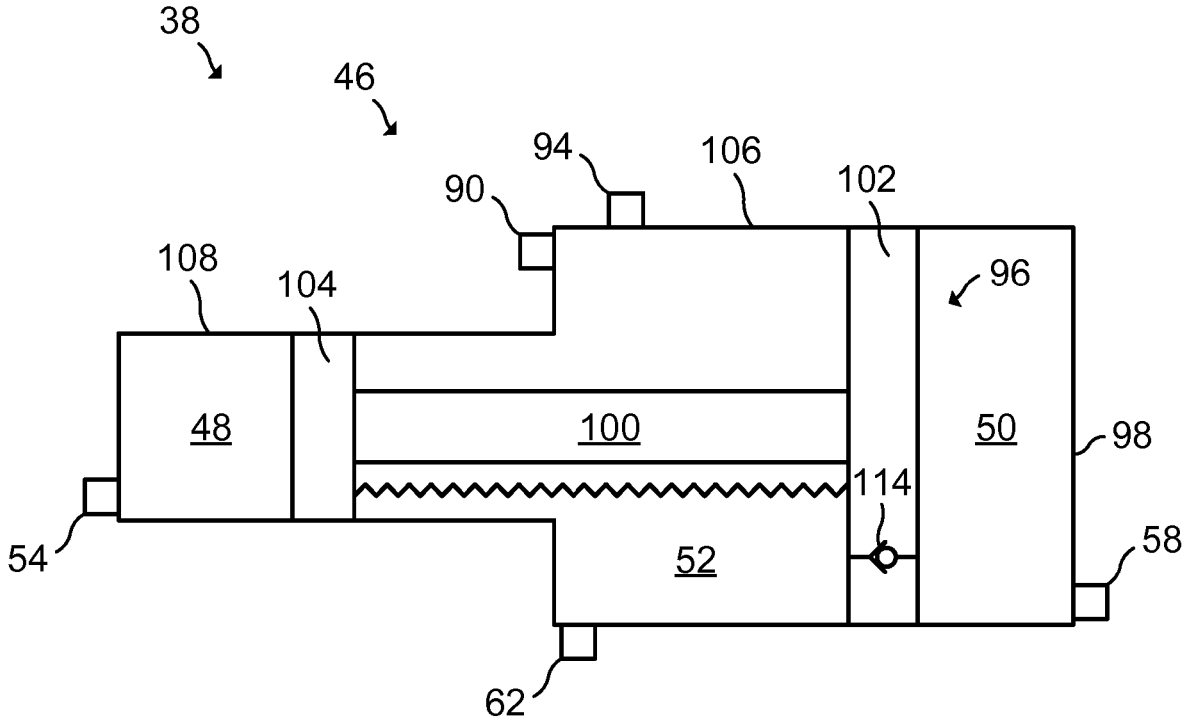
FIG. 5 is a schematic illustration of a hydraulic device according to a further embodiment of the invention.

FIG. 5 is a schematic illustration of a hydraulic device 38 according to a further embodiment of the invention. Mainly differences with respect to the embodiment in FIG. 4 will be described. The hydraulic device 38 in FIG. 5 does not comprise any partition wall between the first cylinder 106 and the second cylinder 108. Instead, a continuous tank chamber 52 is formed between the first piston 102 and the second piston 104 in the first cylinder 106 and in the second cylinder 108. The low-pressure chamber 50 is formed in the first cylinder 106 on one side of the first piston 102. The high-pressure chamber 48 is formed in the second cylinder 108 on one side of the second piston 104. Also in FIG. 5, each of the high-pressure chamber 48, the low-pressure chamber 50 and the tank chamber 52 is limited by a wall of the housing 98.

Figure 6:
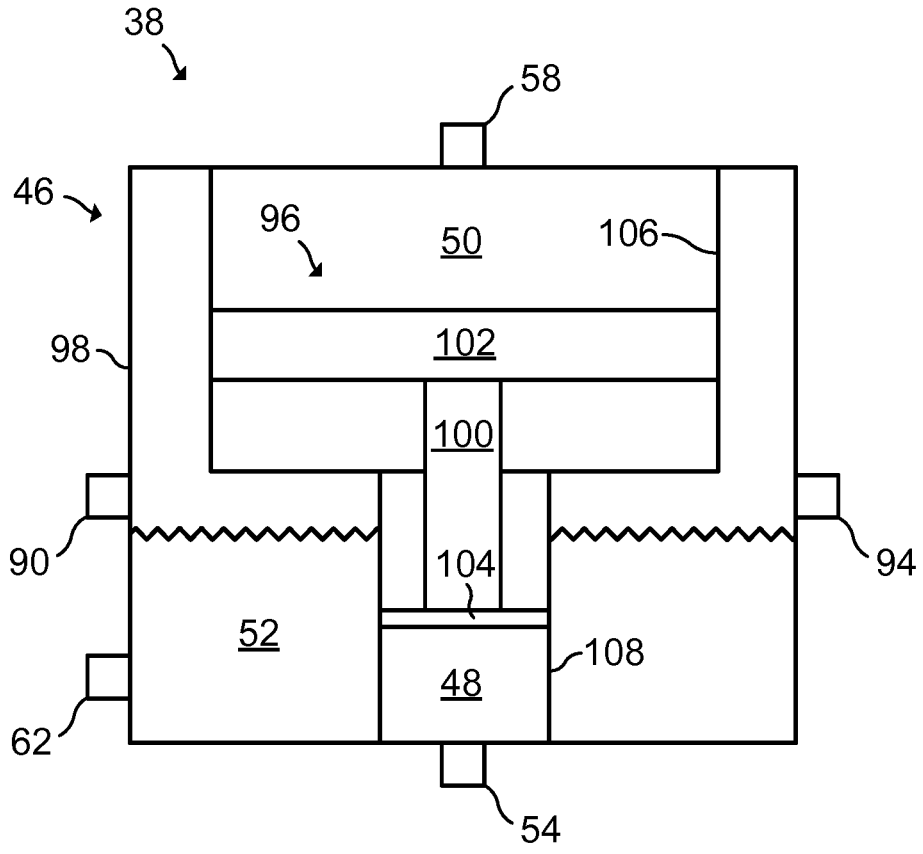
FIG. 6 is a schematic illustration of a hydraulic device according to a further embodiment of the invention.

FIG. 6 is a schematic illustration of a hydraulic device 38 according to a further embodiment of the invention. Mainly differences with respect to the embodiment in FIG. 3 will be described. In FIG. 6, the first cylinder 106 and the second cylinder 108 are provided inside the housing 98. Thereby, a space is formed between the housing 98 and the first cylinder 106. Also in FIG. 6, the housing 98 is constituted by a cylinder. The tank chamber 52 is limited by the housing 98, the first cylinder 106 and the second cylinder 108.

Figure 7:
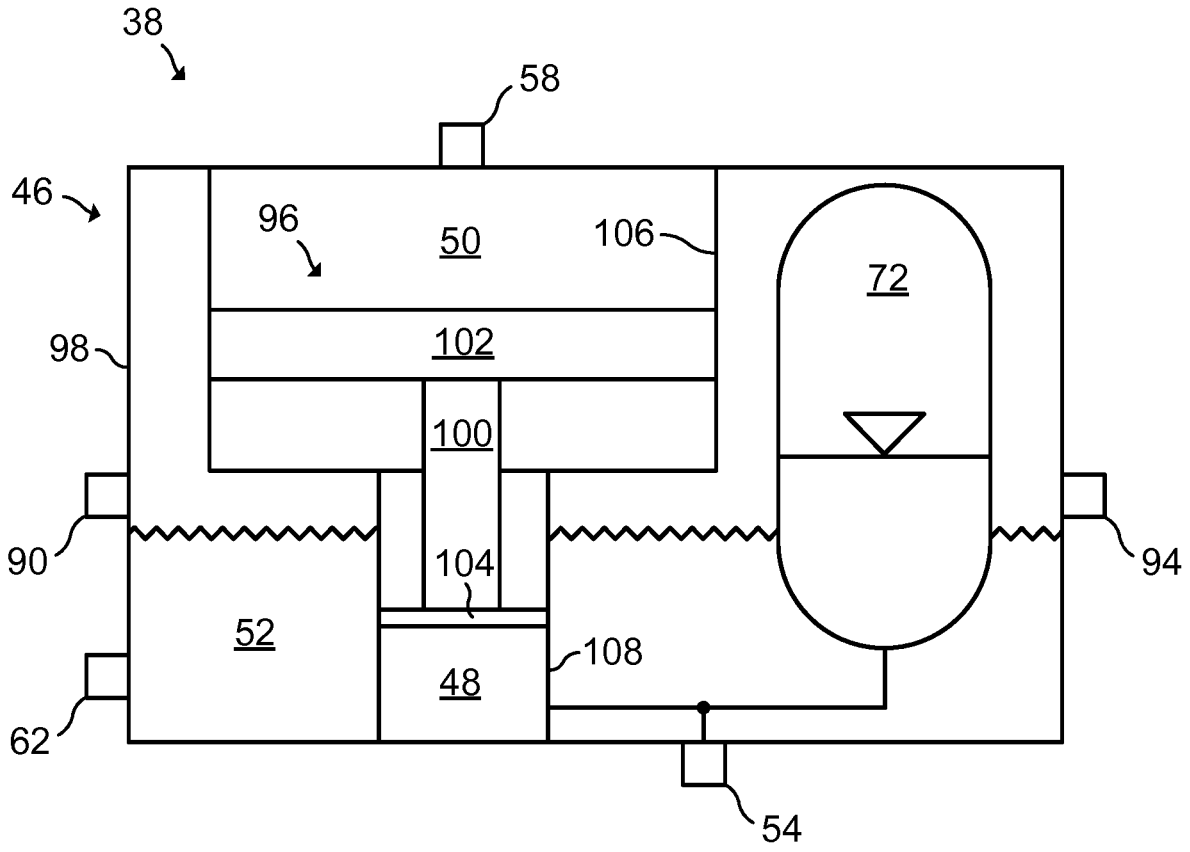
FIG. 7 is a schematic illustration of a hydraulic device according to a further embodiment of the invention.

FIG. 7 is a schematic illustration of a hydraulic device 38 according to a further embodiment of the invention. Mainly differences with respect to the embodiment in FIG. 6 will be described. In FIG. 7, the high-pressure hydraulic energy storage 72 is provided inside the tank chamber 52. The high-pressure hydraulic energy storage 72, the high-pressure chamber 48, the low-pressure chamber 50 and the tank chamber 52 are thus provided in a common housing 98. A hydraulic manifold (not shown) may further be provided to selectively distribute a flow of hydraulic fluid between the high-pressure connection 54, the high-pressure chamber 48 and the high-pressure hydraulic energy storage 72. As an alternative, the high-pressure hydraulic energy storage 72 may be integrated in the low-pressure chamber 50, instead of in the tank chamber 52.

It is to be understood that the present invention is not limited to the embodiments described above and illustrated in the drawings; rather, the skilled person will recognize that many changes and modifications may be made within the scope of the appended claims.

The invention claimed is:

1. A hydraulic device for a hydraulic system, the hydraulic device comprising:

a chamber arrangement comprising at least one high-pressure chamber for connection to a high-pressure side of the hydraulic system, at least one low-pressure chamber for connection to a low-pressure side of the hydraulic system, and at least one tank chamber for connection to a tank-pressure side of the hydraulic system;

a movable member arranged to reciprocate at least partly inside the chamber arrangement in response to pressure variations within the at least one high-pressure chamber and within the at least one low-pressure chamber; and a housing, wherein the at least one high-pressure chamber, the at least one low-pressure chamber and the at least one tank chamber are provided inside the housing, and the at least one tank chamber is limited by a wall of the housing.

2. The hydraulic device according to claim 1, wherein the at least one tank chamber is configured to communicate air with the atmosphere.

3. The hydraulic device according to claim 1, wherein the at least one tank chamber is vented to the atmosphere.

4. The hydraulic device according to claim 1, wherein the at least one high-pressure chamber and/or the at least one low-pressure chamber is limited by the wall of the housing.

5. The hydraulic device according to claim 1, further comprising at least one high-pressure hydraulic energy storage for connection to the high-pressure side, wherein the at least one high-pressure hydraulic energy storage is arranged inside one of the at least one tank chamber or inside one of the at least one low-pressure chamber.

6. The hydraulic device according to claim 1, wherein the chamber arrangement comprises a first cylinder and a second cylinder.

7. The hydraulic device according to claim 6, wherein the at least one tank chamber is provided inside the first cylinder and/or the second cylinder.

8. The hydraulic device according to claim 6, wherein the first cylinder has a larger interior cross-sectional area than the second cylinder.

9. The hydraulic device according to claim 8, wherein the second cylinder is arranged inside the first cylinder.

10. The hydraulic device according to claim 1, wherein the movable member comprises two pistons.

11. The hydraulic device according to claim 6, wherein the movable member comprises two pistons, wherein a first piston is arranged to reciprocate inside the first cylinder, wherein a second piston is arranged to reciprocate inside the second cylinder, and wherein the second piston delimits one of the at least one high-pressure chamber.

12. The hydraulic device according to claim 10, wherein at least one of the pistons delimits one of the at least one tank chamber.

13. A hydraulic system for a working machine, the hydraulic system comprising:

a high-pressure side arranged to both produce and receive a volume flow at a first pressure level;

a low-pressure side arranged to both produce and receive a volume flow at a second pressure level lower than the first pressure level;

a tank-pressure side; and a hydraulic device comprising:

a chamber arrangement comprising at least one high-pressure chamber for connection to the high-pressure side, at least one low-pressure chamber for connection to the low-pressure side, and at least one tank chamber for connection to the tank-pressure side; and a movable member arranged to reciprocate at least partly inside the chamber arrangement in response to pressure variations within the at least one high-pressure chamber and within the at least one low-pressure chamber.

14. The hydraulic system according to claim 13, wherein the movable member comprises a high-pressure area in the at least one high-pressure chamber and a low-pressure area in the at least one low-pressure chamber, and wherein a ratio between the high-pressure area and the low-pressure area substantially corresponds to a pressure ratio between the high-pressure side and the low-pressure side in operation of the hydraulic system.

15. The hydraulic system according to claim 13, further comprising a main pump connected between the low-pressure side and the high-pressure side.

16. The hydraulic system according to claim 13, further comprising an auxiliary pump connected between the tank-pressure side and one of the high-pressure side and the low-pressure side.

17. A working machine comprising a hydraulic system according to claim 13.

18. A hydraulic device for a hydraulic system, the hydraulic device comprising:

a chamber arrangement comprising at least one high-pressure chamber for connection to a high-pressure side of the hydraulic system, at least one low-pressure chamber for connection to a low-pressure side of the hydraulic system, and at least one tank chamber for connection to a tank-pressure side of the hydraulic system;

a movable member arranged to reciprocate at least partly inside the chamber arrangement in response to pressure variations within the at least one high-pressure chamber and within the at least one low-pressure chamber; and at least one high-pressure hydraulic energy storage for connection to the high-pressure side, wherein the at least one high-pressure hydraulic energy storage is arranged inside one of the at least one tank chamber or inside one of the at least one low-pressure chamber.

* * * * *